US006382716B1

(12) United States Patent
Wu

(10) Patent No.: US 6,382,716 B1
(45) Date of Patent: May 7, 2002

(54) FOLDING CHAIR WITH SAFETY GUARD

(76) Inventor: Henry Wu, 23441 Golden Springs Dr., #370, Diamond Bar, CA (US) 91765

( * ) Notice: Subject to any disclaimer, the term of this patent is extended or adjusted under 35 U.S.C. 154(b) by 0 days.

(21) Appl. No.: 09/604,201

(22) Filed: Jun. 27, 2000

Related U.S. Application Data

(63) Continuation-in-part of application No. 09/195,357, filed on Nov. 19, 1998, now Pat. No. 6,092,866.

(51) Int. Cl.[7] ..... A47C 4/24
(52) U.S. Cl. ..... 297/56; 108/118
(58) Field of Search ..... 297/16.1, 55, 56, 297/58; 108/118

(56) References Cited

U.S. PATENT DOCUMENTS

| | | | | |
|---|---|---|---|---|
| 133,503 | A | * 11/1872 | Travis et al. | 297/56 |
| 202,856 | A | 4/1878 | Morse et al. | |
| 937,567 | A | 10/1909 | Canouts | |
| 941,135 | A | 11/1909 | De Moulin | |
| 1,176,915 | A | 3/1916 | Loveless | |
| 1,424,031 | A | 7/1922 | Peters | |
| 1,815,643 | A | 7/1931 | Allerding | |
| 1,833,177 | A | * 11/1931 | Rice | 108/118 |
| 1,838,213 | A | 12/1931 | Buffington | |
| 1,900,483 | A | 3/1933 | Clarin | |
| 2,587,543 | A | 2/1952 | Smith | |
| 2,694,442 | A | 11/1954 | Nordmark | |
| 2,802,578 | A | * 8/1957 | Barile | 108/118 |
| 2,920,687 | A | 1/1960 | Hurley | |
| 2,973,803 | A | 3/1961 | Mickelson | |
| 3,025,101 | A | 3/1962 | McKinnie | |
| 3,649,074 | A | * 3/1972 | McDonald et al. | 297/56 |
| 3,695,687 | A | 10/1972 | Uyeda | |
| 5,738,408 | A | 4/1998 | Wu | |
| 6,092,866 | A | 7/2000 | Wu | |

* cited by examiner

*Primary Examiner*—Peter R. Brown
(74) *Attorney, Agent, or Firm*—Knobbe, Martens, Olson & Bear, LLP

(57) ABSTRACT

A folding chair comprising a first and second safety brace member that provide the chair with additional structural integrity. The chair having a folded configuration and an unfolded configuration comprises first and second chair support members that are pivotally attached to each other so as to define a central pivot axis such that the chair is manipulated between the folded and unfolded configurations by tilting the first and second chair support members with respect to each other about the central pivot axis. The chair further comprises a seat which extends between the first and second chair support members such that the seat is aligned with the support members in the folded configuration and horizontally aligned in the unfolded configuration. Respective first and second ends of each brace member are slidably mounted to the first and second chair support members so that that they are able to accommodate tilting of the first and second chair support members of the chair between the folded and unfolded configurations. In the folded configuration, the brace members are aligned with the first and second chair support members of the folding chair so as to enable a plurality of such chairs to be stacked within a reduced space. In the unfolded configuration, the brace members apply inward forces on the first and second support members so as to inhibit hyperextension of the first and second support members.

22 Claims, 8 Drawing Sheets

FOLDING CHAIR WITH SAFETY GUARD

RELATED APPLICATIONS

This application is a continuation-in-part application of U.S. application Ser. No. 09/195,357 filed Nov. 19, 1998 now U.S. Pat. No. 6,092,866 entitled FOLDING CHAIR WITH SAFETY GUARD, which is hereby incorporated by reference in its entirety.

BACKGROUND OF THE INVENTION

1. Field of the Invention

The present invention relates to folding chairs and in particular relates to a folding chair that contains a safety guard to improve the structural integrity of the chair.

2. Description of the Related Art

People often use low cost folding chairs as a means for sitting in an upright position. In comparison to other seating devices, low cost folding chairs offer the advantages of being compact and lightweight. Therefore, folding chairs can be easily stored, easily transported, and supplied in great numbers at a reasonable cost.

A typical low cost folding chair consists of a seat rest, a back rest, and a plurality of foldable support structures that, when in an open position, enable the seat rest to support the weight of a person. Furthermore, the back rest helps to prevent the person from falling backwards while the person is seated in the seat rest.

The problem with many low cost folding chairs is that they sometimes lack sufficient structural integrity to support extremely heavy individuals. When a heavy individual sits in a folding chair, large internal forces are sometimes generated throughout the folding chair. It is possible for these forces to exceed the capabilities of the folding chair and result in a mechanical failure that can result in a collapse of the chair and possible injury to the person sitting in the chair.

Another problem with folding chairs is that they can sometimes inadvertently fold up while an individual is sitting in the chair. For example, if a person sitting in a folding chair attempts to pull himself forward toward a table, it is possible for the legs of the folding chair to experience forces that could cause the legs to fold together. Moreover, it is possible for the legs to approach each other to the extent that the stability of the chair could be compromised. In either circumstance, the person sitting in the chair may become unbalanced and possibly fall or, at a minimum, have to inconveniently readjust the chair.

The potential loss of mechanical stability in a folding chair poses a serious risk of injury to the user. Without a supporting structure, gravitational forces acting on an object placed at the height of 18 inches, the height of a typical seat rest, would cause the object to collide with the ground with a speed of 10 feet per second. If the ground were a solid structure such as concrete or brick, then a falling user would most likely experience extreme collision forces that could easily cause injury to the person. This problem is compounded by the likelihood that the person's rear end will often contact the floor first risking injury to the person's tailbone or possibly their back.

To address the forgoing concerns, folding chairs have been developed with additional structural elements. In particular, some folding chairs include a safety brace that applies inward forces on the main structural support structures when the chair is unfolded and a person is sitting in the chair. Furthermore, the brace is mounted to the chair so that it does not prevent a person from folding and unfolding the chair.

For example, some references disclose the concept of slidably mounting a first end of the brace to the chair so as to enable folding and unfolding of the chair. However, if the chair is treated roughly or if the chair is folded, stacked, transported, and unfolded many times, it is possible that the shape of the brace will become deformed. Consequently, it is likely that the sliding mechanism will not work properly, thus making it difficult or impossible to fold and unfold the chair.

From the foregoing, it will be appreciated that there is a need for a folding chair that is capable of supporting the weight of extremely heavy individuals. To this end, there is a need for a chair that is more structurally sound such that a failure of one component or piece of the chair will not necessarily result in the user falling to the ground. Furthermore, this folding chair should be lightweight, easy to use, and inexpensive to produce. Moreover, the folding chair should be able to withstand substantial abuse and repeated usage without loosing the ability to easily fold and unfold.

SUMMARY OF THE INVENTION

The aforementioned needs are satisfied by the present invention which, according to one aspect, is a folding chair having a folded and an unfolded configuration. The folding chair comprises a first support member having a first linking element and a second support member having a second linking element. The first and second chair support members are pivotally attached to each other so as to enable tilting of the first chair support member with respect to the second chair support member. The folded configuration results in (a) the first and second chair support members being substantially aligned with each other and (b) the first and second linking elements being a first distance apart. The unfolded configuration results in (a) the first and second chair support members being substantially tilted with respect to each other and (b) the first and second linking elements being a second distance from each other. The folding chair further comprises a seat that is attached to the first and second chair support members. The seat is substantially aligned with the first and second chair support members when the chair is in the folded configuration and the seat is substantially parallel to a surface upon which the first and second chair support members are positioned when the chair is in the unfolded configuration so as to enable a user to rest thereon in a seated position. The folding chair further comprises a first brace member having first and second ends. The first end of the first brace member is slidably attached to the first linking element of the first chair support member and the second end of the first brace member is slidably attached to the second linking element. The first brace member allows the distance between the first and second linking elements to vary between the first and second distances so as to enable the chair to be manipulated between the folded and unfolded configurations. The first brace member inhibits the distance between the first and second linking elements from increasing beyond the second distance so as to reduce the likelihood of the chair collapsing in response to a downward force applied on the seat when the seat is in the unfolded configuration.

In another aspect of the present invention, a folding chair is provided which comprises a first support member and a second support member pivotally attached to the first support member so as to enable the first support member to be tilted with respect to the second support member between (a) an unfolded position such that an opening angle is defined between the first and second support members and (b) a folded position such that the first and second support members are substantially aligned with each other. The folding chair further comprises a seat member coupled to the first and second support members so that the seat member is substantially aligned with the first and second support members when the first and second support members are in the folded position and so that the seat member extends between the first and second support members when the first and second support members are in the unfolded position so that the seat member is able to support the weight of an individual. The folding chair further comprises a first and second rigid safety brace member each having a first and second end. The first ends of the first and second safety brace members are slidably and rotatably attached to the first support member and the second ends of the first and second safety brace members are slidably and rotatably attached to the second support member. The first and second safety brace members inhibit the first and second support members from hyperextending beyond the open angle and the first and second safety brace members provide the first and second support members with the freedom to tilt between the unfolded position and the folded position.

In yet another aspect of the present invention, a folding chair is provided which comprises a first support member and a second support member pivotally attached to the first support member so as to enable the first support member to be tilted with respect to the second support member between (a) an unfolded configuration such that an opening angle is defined between the first and second support members and (b) a folded configuration such that the first and second support members are substantially aligned with each other. The folding chair further comprises a seat member coupled to the first and second support members such that the seat member is substantially aligned with the first and second support members when the first and second support members are in the folded configuration and such that the seat member extends between the first and second support members when the first and second support members are in the unfolded configuration so that the seat member is able to support the weight of an individual. The folding chair further comprises a brace member having a first and second end, wherein the first end of the brace member is attached to the first support member such that the first end of the brace member is movable over a first interval with respect to the first support member. Furthermore, the second end of the brace member is attached to the second support member such that the second end of the brace member is movable over a second interval with respect to the second support member. The brace member inhibits the first and second support members from hyperextending beyond the open angle. The first and second intervals are selected so that the brace member does not inhibit the first and second support members from tilting with respect to each other between the folded and unfolded configurations even if one of the first and second ends of the brace member is no longer able to move with respect to the corresponding first or second support members.

From the foregoing, it should be apparent that folding chair of the present invention contains supplementary structural elements that are sufficient to allow the chair to support the weight of extremely heavy individuals. Furthermore, the chair is capable of supporting extremely heavy individuals in the event that the seat becomes dis-attached from the chair. Moreover, the folding chair of the present invention is designed to have an extended usable lifetime with an increased likelihood that the folding chair will be usable even if the supplementary structural elements become damaged. These and other objects and advantages of the present invention will become more apparent from the following description taken in conjunction with the accompanying drawings.

DETAILED DESCRIPTION OF THE PREFERRED EMBODIMENT

Figure 1:
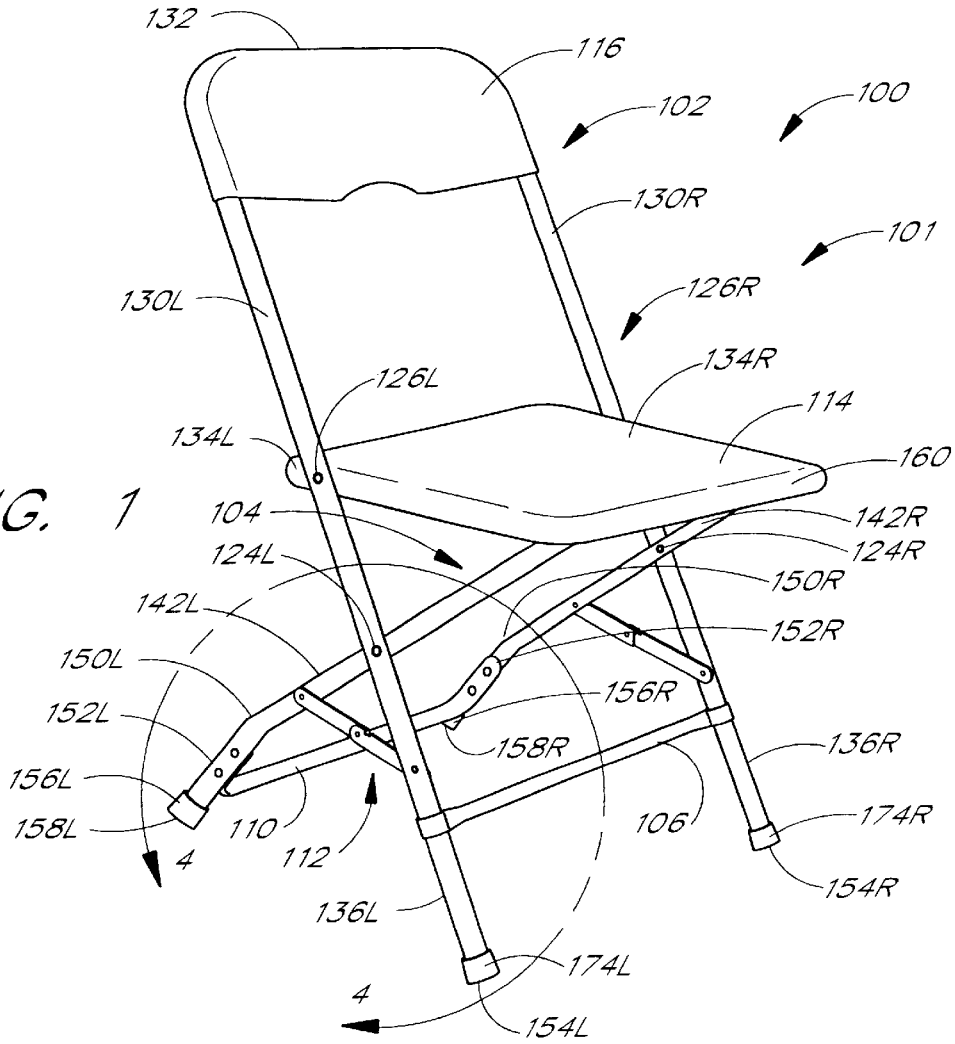
FIG. 1 is a perspective view of a folding chair of the present invention with the chair shown in an open position.
Figure 2:
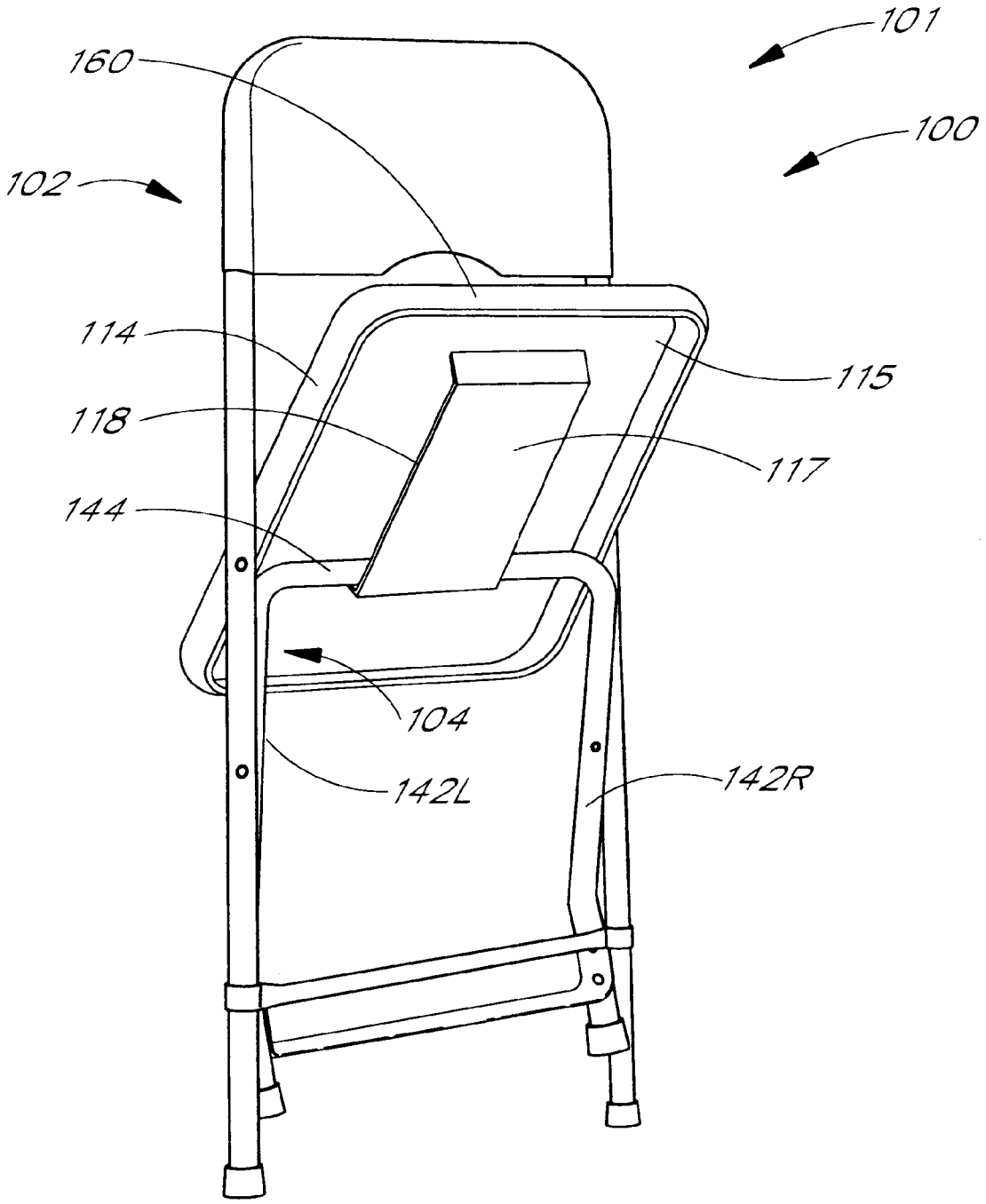
FIG. 2 is a perspective view of the folding chair of FIG. 1 with the chair shown in a folded position.

Reference will now be made to the drawings wherein like numerals referred like parts through out. FIGS. 1 and 2 illustrates the components of a folding chair 100 of the preferred embodiment. FIG. 1 depicts the folding chair 100 in a fully open state whereas FIG. 2 depicts the folding chair 100 in a folded state.

The primary source of mechanical support for the folding chair 100 is provided by a primary sub-structure 101 that is comprised of two pivotally connected U-shaped sections 102, 104 that are coupled to a seat rest 114 in a manner described below. To provide supplementary support to the sub-structure 101, a pair of safety guards 112 are attached to the sub-structure 101 to form the folding chair 100 described below.

The first U-shaped section 102 contains a left side section 130L, a lateral section 132 that extends orthogonally from the left section 130L, and a right side section 130R that extends orthogonally from the lateral section 132 to complete the U-shape of the section 102. In this description, the left side section 130L is on the left side of the folding chair 100 as defined by an observer looking at the front of the folding chair 100. The lower parts of sections 130L, 130R serve as a pair of front legs 136L, 136R with front bottom edges 154L, 154R. The bottom edges are covered with a pair of protective front shoes 174L, 174R that are adapted to provide non-slip contact with the floor so as to maintain the folding chair 100 in place.

The first U-shaped section 102 further contains a flat back rest 116 that is preferably fabricated from molded plastic. The back rest 116 is adapted to attach to the first U-shaped section 102 adjacent the lateral section 132 in a manner that allows the back rest 116 to be supported by sections 130L, 132 and 130R in a manner that is known in the art. The purpose of the back rest 116 is to allow the user to obtain a comfortable sitting position and to prevent the user from falling out of the folding chair 100 in a backwards direction.

The first U-shaped section 102 further contains a front brace 106 that connects the left and right sections 130L, 130R together at locations adjacent the front legs 136L, 136R. In this embodiment, the front brace 106 is located at the ends of the left section 130L and the right section 130R adjacent the front legs 136L and 136R respectively. The purpose of the front brace 106 is to provide lateral support to the first U-shaped section 102 so as to maintain the front legs 136L and 136R a first distance from each other that is selected to provide stability for the folding chair 100.

The second U-shaped section 104 contains a left section 142L, a lateral section 144 (see FIG. 2) that extends orthogonally from the left section 142L, and a right section 142R that extends orthogonally from the lateral section 144 to form the U-shape of the section 104. The left and right sections 142L, 142R contain a plurality of slight bends that enable the folding chair 100 to fold up in a compact manner as described below. The lateral section 144 is situated under the seat rest 114 as shown in FIG. 2 in a manner which is further described below. The lower parts of sections 142L, 142R serve as a pair of rear legs 152L, 152R with rear bottom edges 158L, 158R. The bottom edges are covered with a pair of protective rear shoes 156L, 156R that are adapted to provide non-slip contact with the floor so as to maintain the folding chair 100 in place.

The second U-shaped section 104 further contains a rear brace 110 that connects the left and right rear legs 152L, 152R together. In this embodiment, the rear brace 110 is located at the ends of the left section 142L and the right section 142R adjacent the rear legs 152L and 152R respectively. The purpose of the rear brace 110 is to provide lateral support to the second U-shaped section 104 so that the rear legs 152L and 152R are maintained a first distance apart from each other that is selected so as to provide stability for the folding chair 100.

The two U-shaped sections 102, 104 are pivotally attached at a pair of central pivot points 124L, 124R that coincide with the side sections 130L, 130R and 142L, 142R of the U-shaped sections 102, 104 respectively. The U-shaped sections 102, 104 are attached to each other in a manner that allows the sections 102, 104 to be aligned in a common plane when the chair 100 is in a folded or closed position. In addition, the U-shaped sections 102, 104 are attached to each other in a manner that allows the sections 102, 104 to be tilted with respect to each other such that the lateral section 144 of the second U-shaped section 104 10 supports the front of the folding chair 100 and the lateral section 132 of the first U-shaped section 102 supports the backrest 116 of the chair 100 when the chair is in an unfolded or open position.

The seat rest 114 is pivotally attached at a pair of rear corners 134L, 134R to a pair of pivot points 126L, 126R located on the first U-shaped section 102. The seat rest 114 is adapted to support the weight of the user when the user is seated in the chair 100. As shown in FIG. 2, a guide plate 117 is attached to a bottom surface 115 of the seat rest 114 to ensure that the seat rest 114 is supported at the front edge 160 when the folding chair 100 is in an open position. In particular, the lateral section 144 of the second U-section 104 is interposed between the guide plate 117 and the seat rest 114 so that the lateral section 144 is captured within a slot 118 that is formed between the bottom surface 115 and the guide plate 117. The lateral section 144 is movable within the slot 118 so that, when the user unfolds the folding chair 100 by placing the seat rest 114 into a horizontal position in a manner described below, the guide plate 117 directs the lateral section 144 of the second U-section 104 to be positioned adjacent the front edge 160 of the seat rest 114.

In a fully open position, the U-shaped sections 102, 104 are extended to a maximum angular displacement that is limited by the contact between the front edge 160 of the seat rest 114 and the lateral section 144 of the second U-section 104 as shown in FIG. 1. In a corresponding manner, the front legs 136L, 136R and rear legs 152L, 152R are simultaneously extended from each other to form a solid base of support for the folding chair 100. With the folding chair 100 unfolded in the foregoing manner and placed on a level solid surface with all four legs 136L, 136R and 152L, 152R touching the surface, the seat rest 114 of the folding chair 100 provides a horizontal sitting surface that is capable of supporting the weight of most individuals under normal conditions.

The primary source of mechanical support for the folding chair 100 is provided by the primary sub-structure 101 comprised of the two pivotally connected U-shaped section 102, 104 coupled to the seat rest 114 in the manner described above. However, if the seat rest 114 experiences a mechanical failure, the mechanical stability of the sub-structure 101 could be compromised, resulting in the user possibly falling to the floor. To improve the mechanical stability of the folding chair 100 and reduce the risk of the user falling to the floor, the pair of safety guards 112 are included in the design of the folding chair 100 in a manner described below.

Figure 3A:
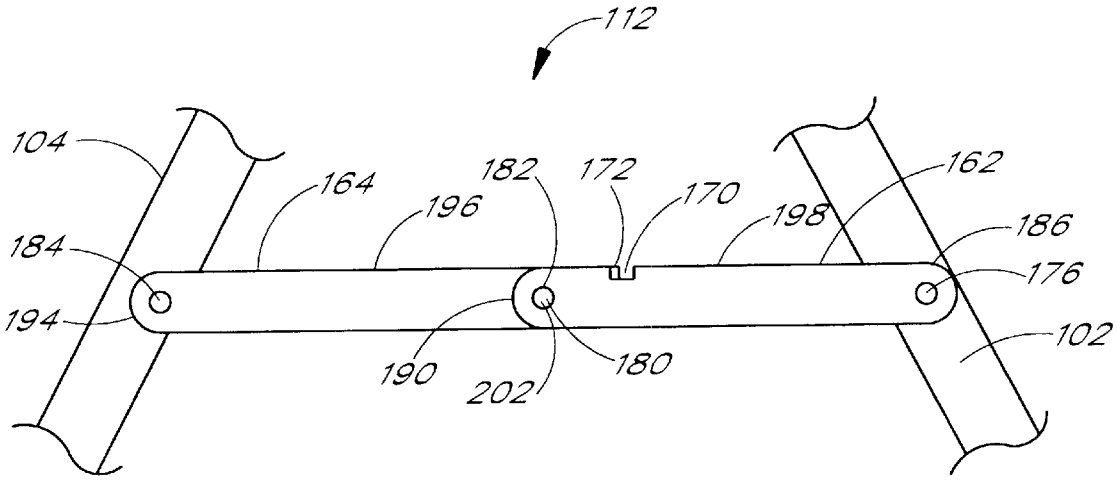
FIG. 3A is a plan view of a safety guard of the folding chair of FIG. 1 illustrating the safety guard in a fully extended position.
Figure 3B:
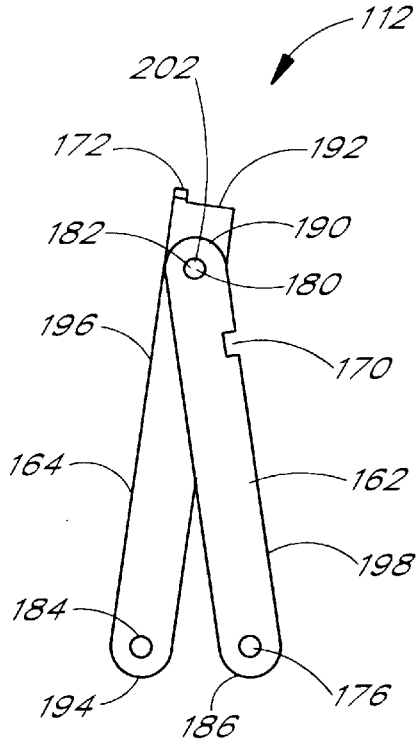
FIG. 3B is a plan view of the safety guard of the folding chair of FIG. 1 illustrating the safety guard in a folded position.
Figure 3C:
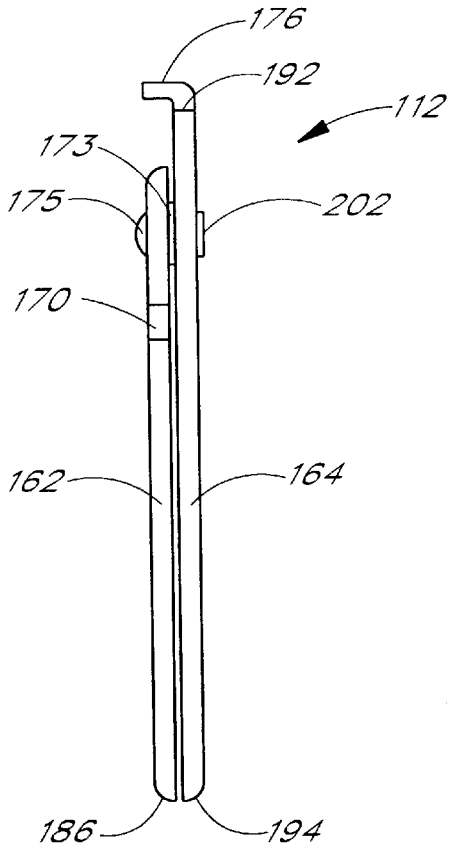
FIG. 3C is a side view of the safety guard of the folding chair of FIG. 1 illustrating the safety guard in a folded position.

In particular, FIGS. 3A–C illustrate the design of an individual safety guard 112. Each safety guard 112, in this embodiment, is comprised of a front section 162 and a rear section 164 both of which are constructed of steel with an approximate width of 0.50 inches, an approximate thickness of 0.06 inches, and an approximate length of 4 inches. The sections 162 and 164 are pivotally attached to each other in a manner described below.

The front section 162 contains a front attachment opening 176 and a rear attachment opening 180 that are both located along a centerline of the front section 162. The opening 176 of the front section 162 is located adjacent a rounded front edge 186 of the front section 162 and is used to pivotally attach the front section 162 to the first U-section 102 in a manner described below. The rear opening 180 is located adjacent a rounded rear edge 190 and is used to pivotally attach the front section 162 to the rear section 164 in a manner described below. The front section 162 further contains a rectangular indentation 170 along an upper edge 198 adjacent the rear opening 180. The indentation 170 limits the motion of the safety guard 112 in a manner described below.

The rear section 164 is constructed with a front attachment opening 182 and a rear attachment opening 184 that are located along a centerline of the rear section 164. The front opening 182 of the rear section 164, located adjacent a front edge 192 as shown in FIG. 3C, is used to pivotally attach the rear section 164 to the front section in a manner described below. The rear opening 184 of the rear section 164 is located adjacent a rounded rear edge 194. The rear opening 184 is used to pivotally attach the rear section 164 to the second U-section 104 in a manner described below.

The front edge 192 of the rear section 164 of the safety guard 112 forms a straight edge along most of its length as shown in FIG. 3B. A narrow lip 172 extends in an orthogonal direction from the rear edge 192 adjacent an upper edge 196 as is best shown in FIGS. 3C. As will be described in a following section, the lip 172 engages with the indentation 170 and places a limit on the motion of the safety guard 112.

The front and rear sections 162, 164 of the safety guard 112 are attached to each other in a manner that allows both sections 162, 164 to lie in parallel planes with the rear edge 190 of the front section 162 overlapping the front edge 192 of the rear section 164. Furthermore, the front and rear sections 162, 164 are pivotally attached at a pivot center 202 that coincides with the rear opening 180 of the front section 162 and the front opening 182 of the rear section 164.

In this embodiment, a rotatable coupler in the form of a rivet 175 extends through the rear opening 180 of the front section 162 and the front opening 182 of the rear section 164 to provide a means for pivotally attaching the front and rear section 162, 164 together. In addition, a washer 173 is interposes between sections 162, 164 to provide a minimal spacing between sections 162, 164 to facilitate pivoting motion of the members.

Figure 4:
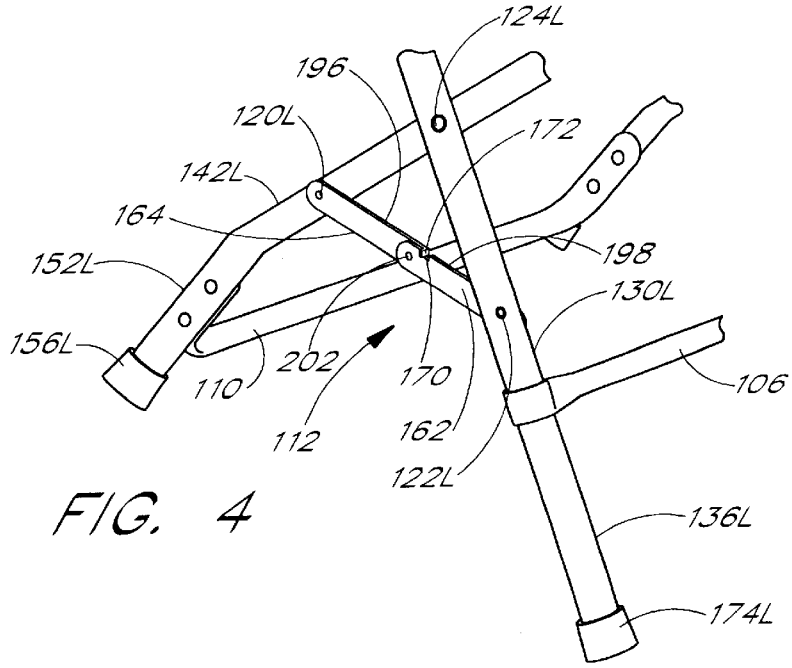
FIG. 4 is a magnified perspective view of the folding chair of FIG. 1 illustrating the safety guard in a fully extended position.

FIG. 4 illustrates the relationship between an individual safety guard 112 and the left side sections 130L and 142L of the U-shaped sections 102 and 104 respectively of the folding chair 100. An identical relationship also exists between the safety guard 112 and the right side sections 130R and 142R of the U-shaped sections 102 and 104.

The safety guards 112 are pivotally attached in a fixed manner to both U-sections 102, 104 of the folding chair 100 below the central pivot points 124L, 124R. In particular, the front sections 162 of the safety guards 112 are attached through the front opening 176 to the side sections 130L, 130R of the first U-section 102 at a pair of front pivot points 122L, 122R located between the central pivot points 124L, 124R and the front brace 106. Furthermore, the rear sections 164 of the safety guards 112 are attached through the rear opening 184 to the side sections 142L, 142R of the second U-section 102 at a pair of rear pivot points 120L, 120R located between the central pivot points 124L, 124R and the rear brace 110.

As mentioned above, the front and rear sections 162, 164 of the safety guides 112 are shaped in a manner that restricts the movement of the pivot center 202 of the safety guides 112. In particular, the indentation 170 adjacent the front edge 190 along an upper edge 198 of the front section 162 is adapted to receive the lip 172 (see FIG. 3A–C) that extends in a perpendicular manner from the front edge 192 of the rear section 164 adjacent the upper edge 196. Moreover, when the U-sections 102, 104 of the folding chair 100 are tilted to a fully open position, the safety guards 112 are fully extended in a simultaneous manner to an extent where the lip 170 makes contact with indentation 172, thus reaching the maximum extension of the safety guards 112 as shown in FIG. 4. In this configuration, the front section 162 and the rear section 164 of the safety guard 112 form a single linear brace between the side section 130 of the first U-shaped member 102 and the side section 142 of the second U-shaped member 104. Furthermore, when the safety guards 112 are placed into a fully extended state, the pivot center 202 of each safety guard 112 lies along a line that joins the rear pivot point 120L, 120R to the front pivot point 122L, 122R.

It will be appreciated that the safety guides 112 add significant structural integrity to the folding chair 100. In particular, if the seat rest 114 undergoes a mechanical failure to the extent where the seat rest 114 is unable to maintain significant inward forces on the U-sections 102, 104, then the safety guards 112 will tend to prevent the folding chair 100 from collapsing by applying equilibrium restoring inward forces on the U-sections 102, 104 at the front and rear pivot points 122L, 122R and 120L, 120R. Furthermore, the supplemental structural support provided by the safety guards 112 reduces the internal stresses throughout the folding chair 100.

In particular, a common failure of these chairs occur when the lateral section 144 of the second U-shaped member 102 deforms the guide plate 117 and escapes from the channel 118. In this circumstance, the force of the person sitting on the seat 114 has a tendency to force the bottom legs 154R/154L of the first U-shaped member 102 away from the bottom legs 174R/174L from the second U-shaped member 104. This can result in an individual positioned on the seat to suddenly be accelerated towards the floor such that the individual hits the floor before the individual has time to react.

To avoid this problem, the braces 112 limit the outward movement of the first U-shaped member 102 from the second U-shaped member 104 in the event that the seat 114 detaches from the U-shaped members 102 or 104. While the seat 114 may no longer be able to support the user, retaining the U-shaped members 102 and 104 at the desired distance from each other reduces the speed of collapse of the chair 100 and provides the individual with more time to step up from the seat of the chair 114 and avoid falling to the floor.

It will be appreciated that the shape of the safety guards 112 described above prevents the pivotally attached safety guards 112 from overextending in a manner that allows the pivot center 202 of each safety guard 112 to fall below a line that joins the rear pivot point 120L, 120R to the front pivot point 122L, 122R. This feature ensures that the pair of safety guards 112 are biased to fold together at the central pivot 202 in a symmetrical manner which allows the folding chair 100 to be more easily converted from an open position to a folded position as will be described in a following section.

It will be appreciated that the safety guards 112 also help to prevent the user from inadvertently causing the folding chair 100 to change from an unfolded state to a folded state. For example, if a user is sitting on the folding chair 100 and pulls themselves forward, it is possible for inward forces to be created that are applied by the ground onto the front legs 136L, 136R. These inward forces have a tendency to urge the first U-shaped member 102 toward the second U-shaped member 104. Hence, without the safety guards 112, it would be possible for the U-sections 102, 104 to dangerously move toward a partially folded state that reduces the stability of the chair 100 which can cause the user to possibly fall out of the chair 100. However, with the safety guards 112 installed and placed in a fully extended position as shown in FIG. 4, inward forces applied onto the safety guards 112 by the U-section 102, 104 at the front and rear pivot points 122L, 122R and 120L, 120R would be directed through the pivot center 202 of the safety guards 112 which would therefore be ineffective at rotating the safety guards 112 into a folded position. Therefore, the fully extended safety guards 112 present an obstacle to the U-sections 102, 104 that help to maintain a fixed relationship between the U-sections 102, 104.

It will be appreciated that the folding chair 100 is easily converted from a folded state to a fully opened state. The user simply places the front legs 136L, 136R of the folding chair 100 on a suitable horizontal surface, holds the first U-section 102 in a vertical manner, and pushes down on the front edge 160 of the seat rest 114 which causes the U-sections 102, 104 to unfold. Subsequently, the user places the folding chair 100 on both the front and rear legs 136L, 136R and 152L, 152R and applies a downward force on the front edge 160 until the lateral section 144 of the second U-section comes into contact with the front edge 160 of the seat rest 114. To ensure that the safety guards 112 are fully extended, the user simply applies a downward force on the middle of each safety guard 112 until the lip 172 of each safety guard 112 comes into contact with the corresponding rectangular indentation 170.

It will be appreciated that the folding chair 100 is easily converted from a fully opened state to a folded state. The user starts the folding process by applying an upward force on the middle of each safety guard 112 which causes the central pivot 202 to rise above the line that joins the front and rear pivot points 122L, 122R and 120L, 120R of the U-sections 102, 104. At this point, the user simply orients the first U-section 102 in a vertical manner and pulls up on the front edge 160 of the seat rest 114 which rotates the seat rest 114 in a manner that exposes the lower surface 115 and directs the lateral section 144 to move away from the front edge 160 of the seat rest 114. The user continues this process until the plane of the seat rest 114 lines up with the plane of the first U-section 102 at which point the U-sections 102, 104 will be aligned with each other and the safety latches 112 will be placed in a folded position.

It will be appreciated that the safety guards 112 are configured to extend with a fully extended orientation when the chair 100 is converted from an unfolded state to a fully opened state. In particular, each safety guards 112 is mounted to the chair 100 in a manner that matches the distance between the front and rear pivot points 122 and 120, measured when the chair 100 is in a fully opened state, with the distance between the front opening 176 and rear opening 184 of the safety guard 112, measured with the safety guard in a fully extended state.

It will also be appreciated that the safety guards 112 are configured to remain extended with a fully extended orientation while a user is sitting in the chair 100. In particular, the engagement between the lip 172 and the indentation 170 of each safety guard 112 in a fully extended orientation prevents the pivot center 202 of the safety guard 112 from falling below a line that joins the front and rear pivot points 122 and 120. This adaptation prevents gravitational forces acting on the safety guard 112 from altering the linear alignment of the safety guards 112.

It will be appreciated that the safety guards 112 provide the folding chair 100 with significant advantages while offering little or no significant drawbacks. In particular, the safety guards 112 provide improved structural reliability to the folding chair 100 and reduce the risk of injury to the user. Furthermore, the safety guards 112 are lightweight, easy to manipulate, inexpensive to produce, and inexpensive to install onto the folding chair 100.

Reference will now be made to FIGS. 5–10 which illustrates a foldable chair 200 in accordance with another aspect of the present invention. The foldable chair 200 of FIGS. 5–10 is substantially similar to the chair of FIG. 1 in that it comprises first and second U-shaped support members 202 and 204 pivotally mounted to each other at pivot points 206, a seat rest 208 that folds and unfolds in coincidence with the support members 202 and 204, and a back rest 210 disposed adjacent an upper section 212 of the first support member 202. However, as will be described in greater detail below, the chair 200 of FIGS. 5–10 includes a different type of safety brace 214 for strengthening the chair such that the brace 214 maintains a uniform shape when the chair is folded and unfolded.

Figure 5:
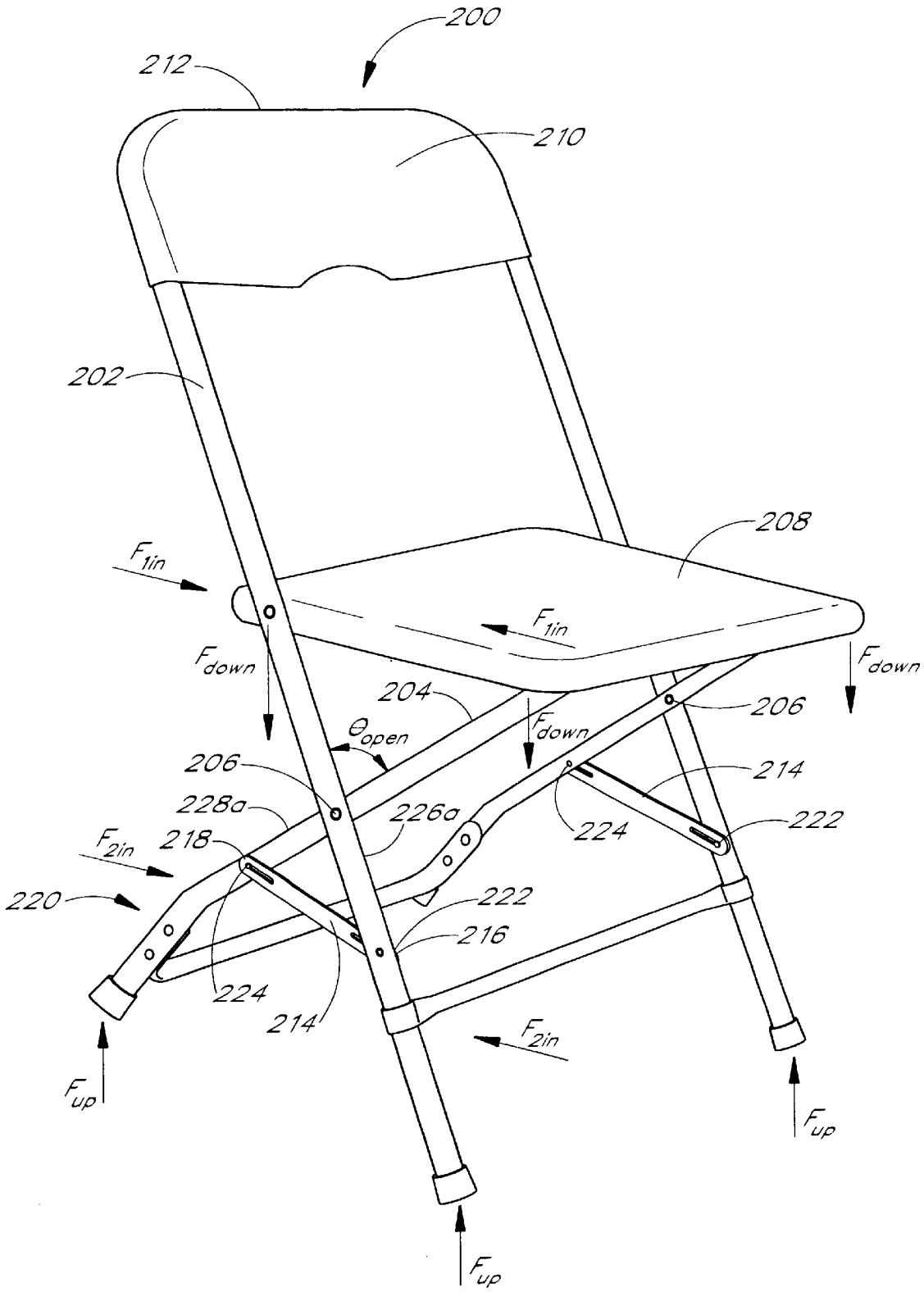
FIG. 5 is a perspective view of a folding chair in accordance with another aspect of the present invention which illustrates the chair shown in an unfolded position.

FIG. 5 illustrates the chair 200 in the unfolded configuration. The chair comprises the first and second support members 202 and 204 that are pivotally mounted to each other at the pivot points 206. In the unfolded configuration, the support members 202 and 204 are tilted about the pivot points 206 so as to define an open angle $\theta_{open}$ therebetween. The chair 200 further comprises the seat 208 which is coupled to the support members 202, 204 in a known manner, such as that described earlier in connection with FIG. 4, so as to allow folding and unfolding of the chair 200 and so that the seat 208 is able to support the weight of an individual when the chair 200 is in the unfolded configuration.

While supporting the weight of an individual, downward forces, $F_{down}$, and upward forces, $F_{up}$, are applied onto the chair support members 202, 204 at locations that are displaced from the pivot points 206. Consequently, a first torque is generated with respect to a central pivot axis of the chair that extends between the pivot points 206. In the absence of any other torque, the first torque would cause the chair support members 202, 204 to hyperextend such that the angle defined therebetween would increase beyond the open angle $\theta_{open}$ and the individual sitting on the seat 208 would accelerate toward the ground and possibly become injured.

To inhibit such a catastrophic event, inward forces, $F_{1in}$ are typically applied by the seat 208 onto the chair support members 202, 204 so as to generate a second torque about the central pivot axis that offsets the first torque. Thus, the chair 200 is maintained in a state of static equilibrium so long as the seat rest 208 is able to apply the required inward forces onto the chair support members 202, 204. However, if the seat 208 becomes sufficiently damaged or detached from the chair support members 202, 204 such that the seat 208 is not able to apply the second torque, then, if no other offsetting torques are provided, the chair 200 will hyperextend and the individual sitting on the seat 208 will accelerate toward the ground and will possibly become seriously injured. As will be described in greater detail below, the safety braces 214 apply a third torque about the central pivot axis that, in the absence of the second torque, offsets the first torque caused by the weight of the user and prevents the chair support members 202, 204 from hyperextending.

As shown in FIG. 5, the chair 200 comprises at least one safety brace 214 and, in the preferred embodiment, comprises a first brace 214 disposed on the left side of the chair 200 and an identical brace 214 disposed on the right side of the chair 200. Each safety brace 214 comprises an elongate rigid body that extends from a first end 216 to a second end 218. The first and second ends 216 and 218 are respectively coupled to the first and second chair support members 202 and 204 such that the braces 214 are offset from the central pivot axis of the chair 200 and such that inward forces, $F_{2in}$, are applied by the ends 216, 218 of the braces 214 onto the chair support members 202, 204 when the chair 200 is in the unfolded configuration. As will be described in greater detail below, the first and second ends 216, 218 of each brace are slidably engaged with the support members 202, 204 which enables the support members 202, 204 to be tilted towards each other about the pivot points 206 so as to enable folding of the chair 200.

In the preferred embodiment, the chair 200 comprises a plurality of linking elements 220 which couple the braces 214 to the support members 202, 204. The linking elements 220 comprise a first linking element 222 extending from a left side section 226*a* of the support member 202 which couples with the first end 216 of the left side brace 214. The linking elements 220 further comprise a second linking element 224 extending from a left side section 228*a* of the second support member 204 which couples with the second end 218 of the left side brace 214. The linking elements 220 further comprise linking elements 222 and 224 that respectively extend from right side sections 226*b* and 228*b* of the support members 202 and 204 and couple with the first and second ends 216, 218 of the right side brace 214 in a manner identical to that of the left side of the chair 200.

Figure 6:
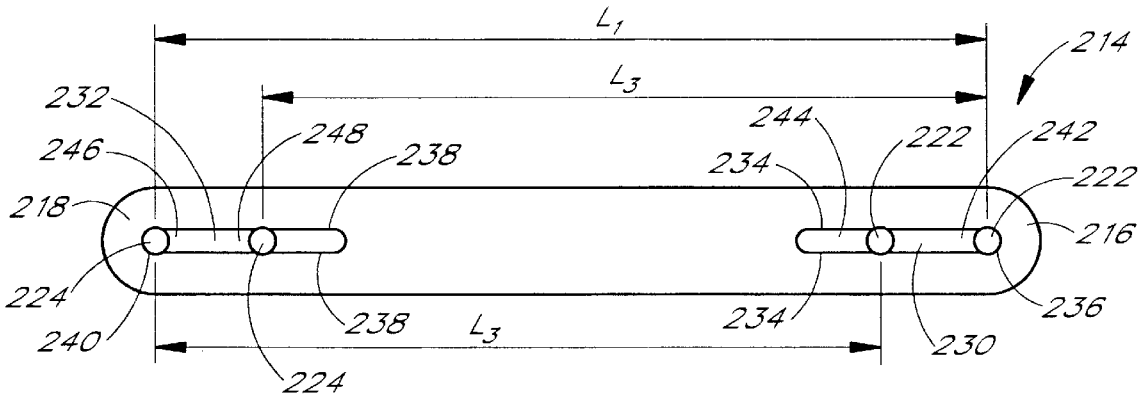
FIG. 6 is a side view of a safety brace of the chair of FIG. 5 which illustrates the shape of the safety brace.

FIG. 6 illustrates one embodiment of the safety brace 214 in greater detail. The brace 214 comprises a simple elongate shape and is formed of strong rigid material, such as steel. Because the brace 214 has a simple shape, the brace 214 can be formed from a variety of inexpensive stock materials such as flat plating, square tubing, round tubing, and the like. In the preferred embodiment, the brace 214 comprises flat steel plating which enables the brace 214 to fit within a relatively narrow space.

As shown in FIG. 6, the brace 214 defines respective first and second slots 230 and 232 adjacent the first and second ends 216 and 218. The first slot 230 extends along the elongate axis of the brace 214 and is defined by opposing longitudinal edges 234 and a terminating lateral edge 236 extending between the edges 234. The terminating edge 236 is disposed adjacent the first end 216 of the brace and the elongate edges 234 extend from the terminating edge 236 toward the center of the brace in a parallel manner. The second slot 232, being substantially similar to the first slot 230, extends along the elongate axis of the brace 214 and is defined by opposing longitudinal edges 232 and a terminating lateral edge 240 disposed adjacent the second end 218 of the brace 214. The elongate edges 238 of the second slot 232 extend from the terminating edge 240 toward the center of the brace 214 in a parallel manner.

As shown in FIG. 6, the slots 230, 232 comprise respective outward regions 242, 246 and respective inward regions 244 and 248. The outward regions 242, 246 are respectively disposed adjacent the terminating edges 236, 240 and the inward regions 244, 248 are displaced toward the center of the brace from the outward regions 242, 246. The outward regions 242, 246 are separated from each other by a first distance $L_1$ corresponding to the distance between the linking elements 222 and 224 when the chair 200 is in the unfolded configuration (See, FIG. 7). Furthermore, the outward region 242 of the first slot 230 is separated from the inward region 248 of the second slot 232 by a second distance $L_2$ corresponding to the distance between the lining elements 222 and 224 when the chair 200 is in the folded configuration (See, FIG. 9). The brace 214 is symmetrically configured such that the inward region 214 of the first slot 230 is separated from the outward region 246 of the second slot 232 by the second distance $L_2$. As will be described in greater detail below, the symmetrical configuration of the brace 214 reduces the likelihood that the brace 214 will prevent the chair 200 from folding or unfolding in the event that one of the linking elements 222, 224 is unable to slide within the respective slots 230, 232.

As shown in FIG. 6, the linking elements 222, 224 extending from the chair support members 202, 204 (FIG. 5) are disposed so that they respectively extend through the slots 230, 232. Thus, the spatial relationship between the linking elements 222, 224 is defined by the geometry of the slots 230, 232. In particular, the respective terminating edges 236, 240 of the slots 230, 232 prevent the linking elements 222, 224 from being separated beyond the first distance $L_1$. Furthermore, the portions of the linking elements 222, 224 extending through the slots 230,232 have a width slightly less than that of the slots 230, 232 that allows the linking elements 222, 224 to freely slide along the slots. Moreover, in a preferred embodiment, the linking elements 222, 224 are able to rotate within the slots 230, 232 so as to provide the ends 216, 218 of the brace 214 with rotational degrees of freedom with respect to the linking elements 222, 224 that enables the brace 214 to align with the support members 202, 204 when the chair 200 is folded. Consequently, because the linking elements 222, 224 can be separated by a distance that varies between $L_1$ and $L_2$ and because the linking elements 222, 224 are allowed to rotate within the slots 230, 232 of the brace 214, the safety braces 214 do not inhibit the chair 200 from being unfolded or folded.

Figure 7:
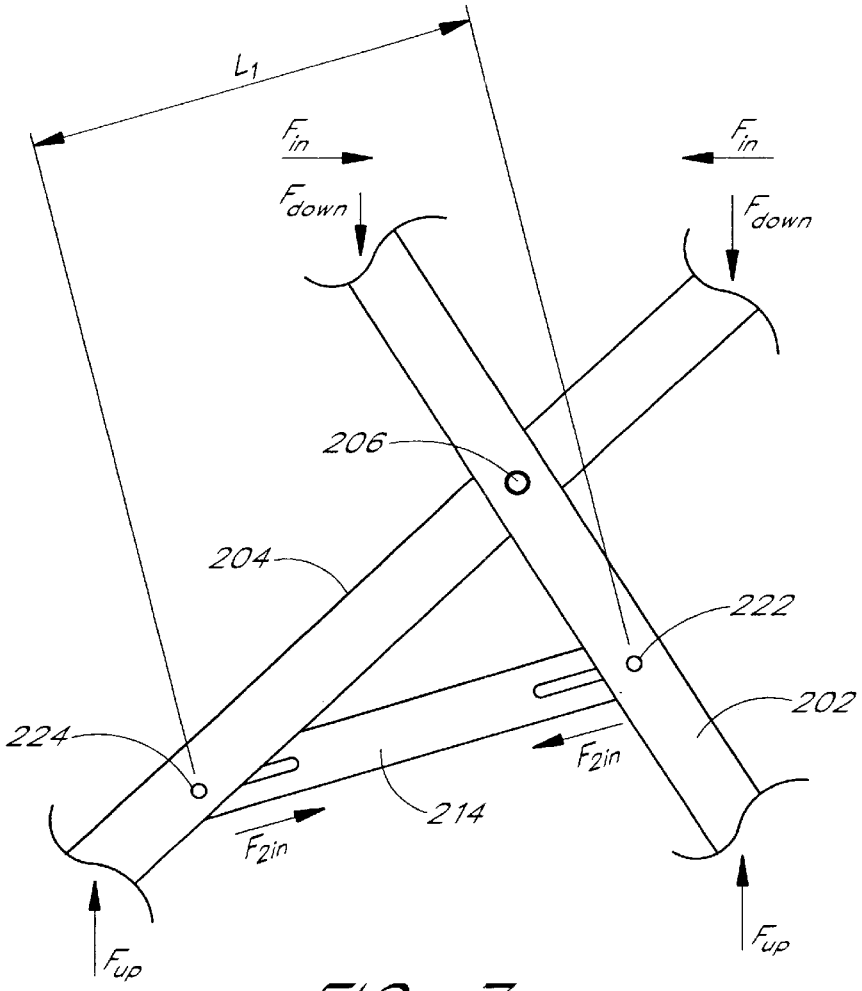
FIG. 7 is a partial side view of the chair of FIG. 5 which illustrates the alignment of the safety brace with respect to a first and second structural members of the chair when the chair is in the unfolded position.

FIGS. 7–10 illustrate the spatial relationship between the safety brace 214 and the chair support members 202, 204 in greater detail. As shown in FIG. 7, when the chair is completely unfolded, the linking elements are displaced from each other by the first distance $L_1$. Consequently, inward forces $F_{2in}$ are applied by the respective ends 216, 218 of the brace 214 onto the linking elements 222, 224 rigidly extending from the support members 202, 204. Thus, the chair support members 202, 204 and the brace 214 form a triangular base of support that enhances the structural integrity of the chair 200. More particularly, each brace 214 reduces the likelihood that vertical forces applied onto the chair support members 202, 204 will result in hyperextension of the chair support members 202, 204 about the pivot points 206.

For example, when an individual sits in the chair, downward forces $F_{down}$, and upward forces, $F_{up}$, are applied onto the chair support members as shown in FIG. 7. These forces produce the first torque about the pivot points 206 that, in the absence of any other torque, would result in hyperextension of the chair support members 202, 204. As mentioned earlier, a second torque that offsets the first torque is usually provided by inward forces $F_{1in}$ applied by the seat onto the chair support members 202, 204. However, even if the inward forces $F_{1in}$ are not provided, for example, because of a mechanical failure of the seat, the braces 214 would provide the third torque that would inhibit hyperextension of the chair support members 202, 204.

In particular, since the linking elements 222, 224 are separated by the first distance $L_1$ when the chair 200 is in the unfolded configuration, contact between the linking elements 222, 224 and the lateral edges 236, 240 of the slots 230, 232 of the brace 214 will result in the inward forces $F_{2in}$ being applied by the brace 214 onto the linking elements 222, 224. Since these forces are offset from the pivot axis and are applied toward each other, they provide the third torque that offsets the first torque. Consequently, since the chair support members 202, 204 are maintained in the unfolded configuration of FIG. 7 even if the seat undergoes a mechanical failure, the likelihood that an individual sitting in the chair 200 will become injured is reduced.

Figure 8:
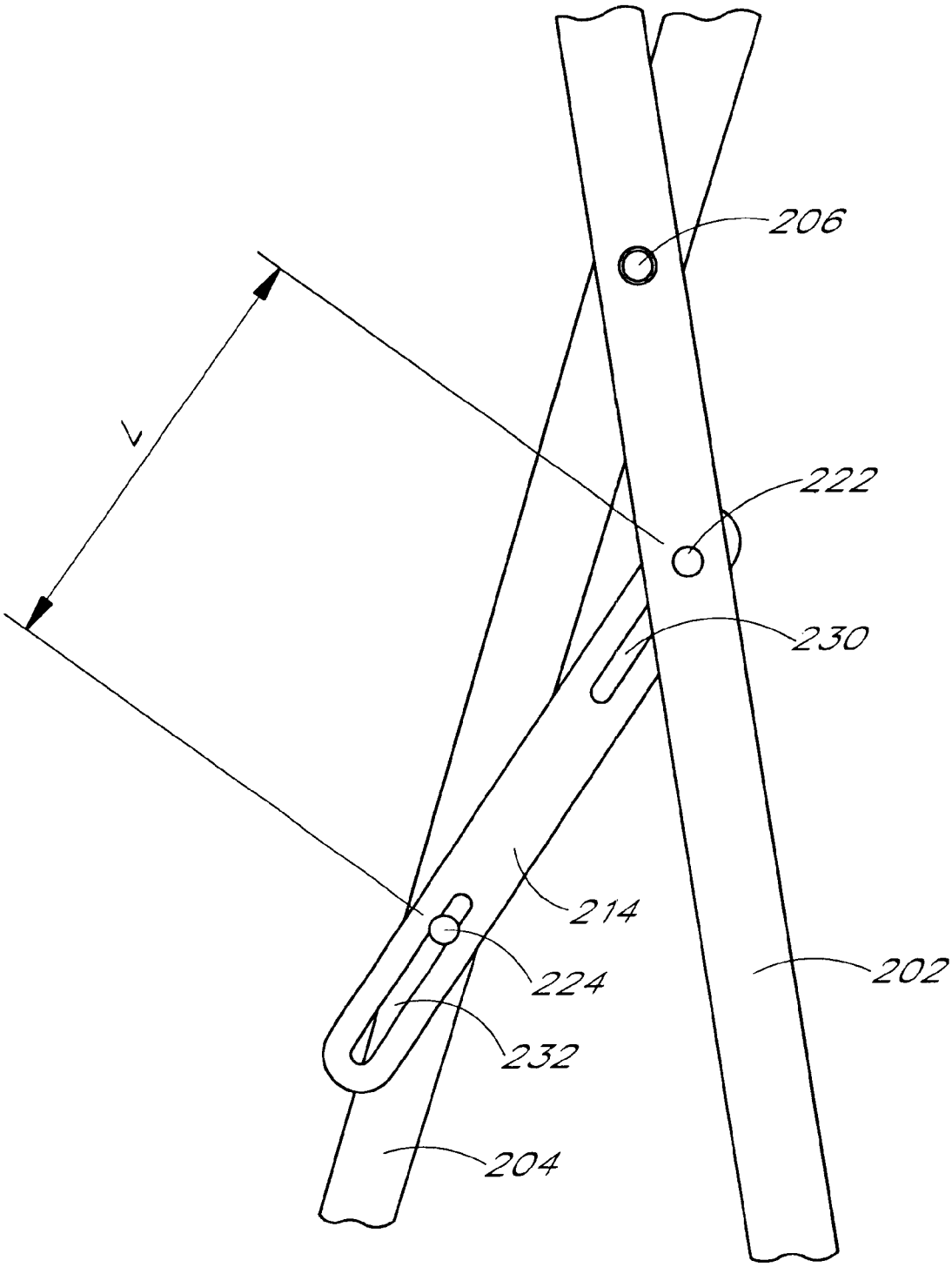
FIG. 8 is a partial side view of the chair of FIG. 5 which illustrates the alignment of the safety brace with respect to a first and second structural members of the chair when the chair is in a partially folded position.
Figure 9:
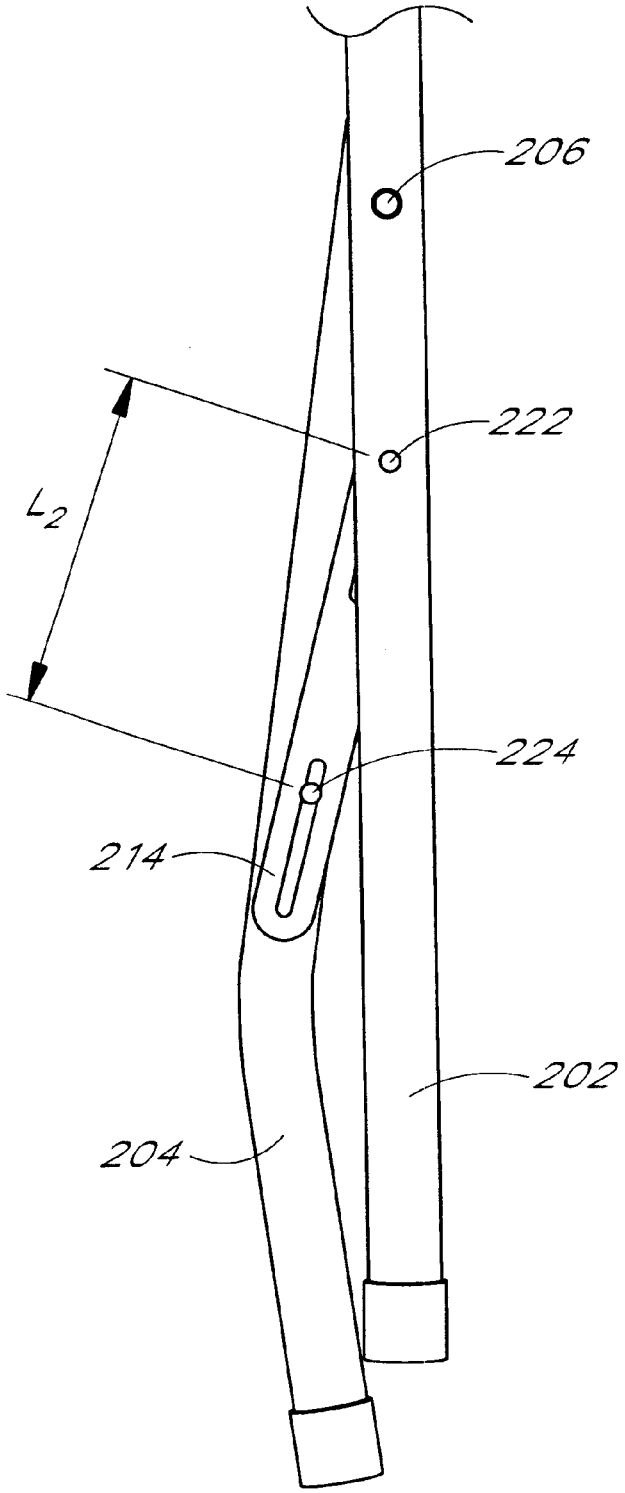
FIG. 9 is a partial side view of the chair of FIG. 5 which illustrates the alignment of the safety brace with respect to the first and second structural members of the chair when the chair is in a completely folded position.

FIGS. 8 and 9 illustrate the relationship between the support members 202, 204 and the safety brace 214 when the support members 202, 204 are tilted toward each other about the pivot points 206. When the support members 202, 204 are initially tilted toward each other, as shown in the partially folded state of FIG. 8, the brace 214 begins to align with the support members 202, 204, as a result of one or both of the linking elements 222, 224 sliding and rotating within the slots 230, 232 of the brace 214, and a reduced distance $L<L_1$ between the linking elements 222, 224 is accommodated. As shown in the fully folded state of FIG. 9, the linking elements 222, 224 are separated by the second distance $L_2<L<L_1$ and the brace 214 is substantially aligned with the support members 202, 204, thereby allowing the folded chair 200 to be stored in a reduced volume of space.

Figure 10:
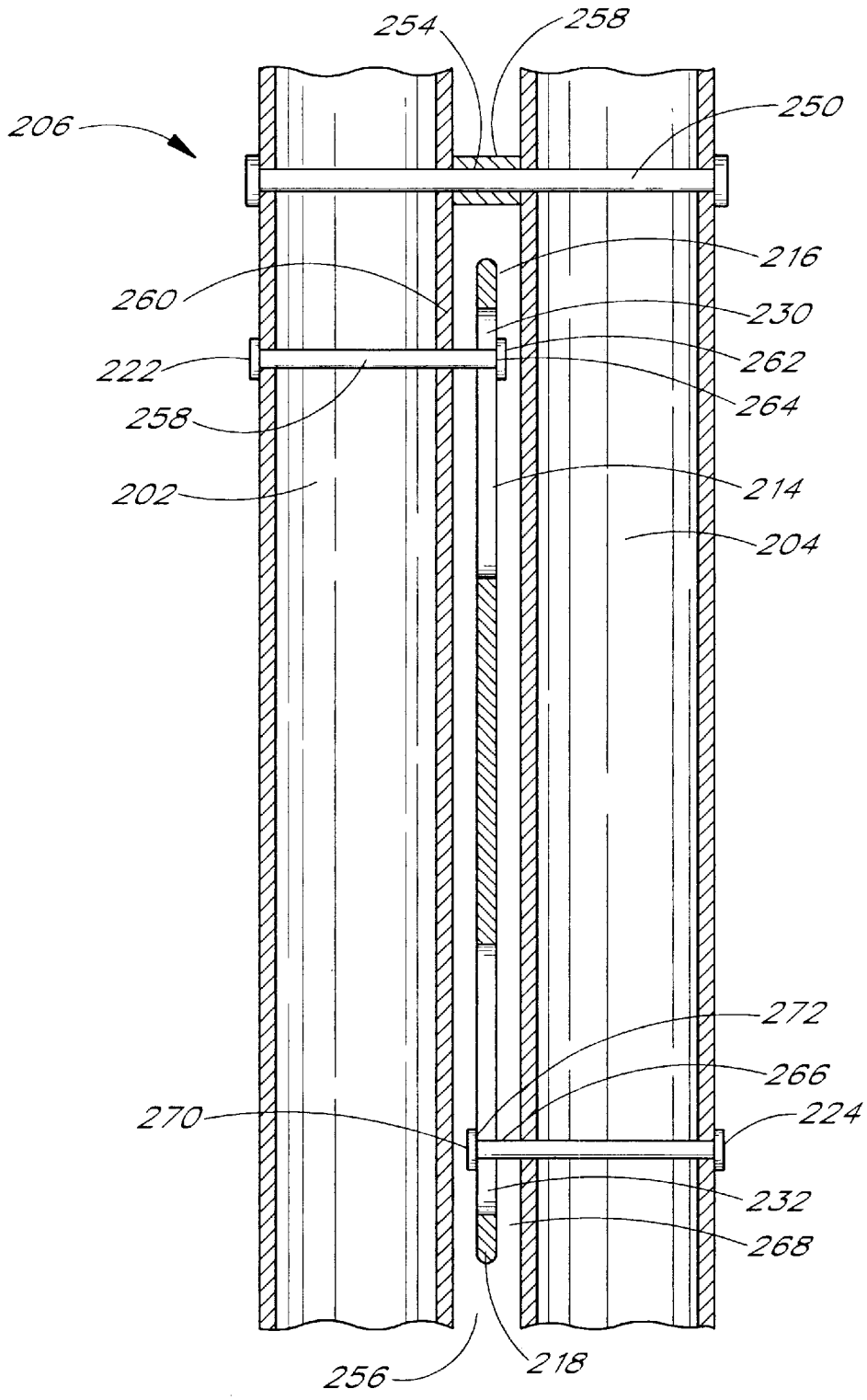
FIG. 10 is a partial front view of the chair of FIG. 5 which illustrates the safety brace member interposed between the first and second structural members when the chair is in the completely folded position.

FIG. 10 is a magnified front view of a portion of the chair 200 in the folded position which illustrates one embodiment of the folding chair 200 in greater detail. In this embodiment, a known coupling pin 250 extends through both of the support members 202, 204 at the pivot point 206 so as to pivotally couple the support members 202, 204 to each other. A known spacer 252 having an opening 254 extending therethrough is interposed between the support members and disposed so that the pin 250 extends through the opening 254 of the spacer 252. The purpose of the spacer 252 is to separate the support members 202, 204 from each other, thereby providing a space 256 for receiving the safety brace 214.

As shown in FIG. 10, the linking elements 222, 224 respectively extend from the support members 202, 204 and are captured by the slots 230, 232 of the safety brace 214. In particular, the first linking element 222 comprises a shank portion 258 extending from an inwardly facing surface 260 of the first support member 202. The shank portion 258 extends through the first slot 230 of the brace 214 and has a width less than that of the first slot 230 so that the shank portion 258 is able to slide within the first slot 230 as described above. The first linking element 222 further comprises a head portion 262 extending from an outer edge 264 of the shank portion 258. The head portion 262 is disposed so that the first end 216 of the safety brace 214 is interposed between the head portion 262 of the first linking element 222 and the inward surface 260 of the first support member 202. Furthermore, the head portion 262 is sized with a width greater than that of the first slot 230 so that the first end 216 of the brace 214 is captured by the first linking element 222.

As shown in FIG. 10, the second linking element 224 comprises a shank portion 266 extending from an outwardly facing surface 268 of the second support member 204. The shank portion 266 extends through the second slot 232 of the brace 214 and has a width less than that of the second slot 232 so that the shank portion 266 is able to slide within the second slot 232 as described above. The second linking element 224 further comprises a head portion 270 extending from an outer edge 272 of the shank portion 266. The head portion 270 is disposed so that the second end 218 of the safety brace 214 is interposed between the head portion 270 of the second linking element 224 and the outward surface 268 of the second support member 204. Furthermore, the head portion 270 is sized with a width greater than that of the second slot 232 so that the second end 218 of the brace 214 is captured by the second linking element 224.

It will be appreciated that safety brace 214 of the chair 200 of FIG. 6 provides the chair 200 with many advantages. In particular, the brace 214 provides the chair 200 with increased structural integrity such that the support members 202, 204 are inhibited from hyperextending even if the seat is no longer able to provide inward forces onto the support members 202, 204. Furthermore, since the safety brace 214 comprises a single rigid element having a simple shape, the safety brace 214 can be manufactured in an inexpensive manner.

Another advantage is provided by the two slot design of the brace 214 which gives the brace 214 an added degree of redundancy that extends the operational lifetime of the chair 200. In particular, the distance between the linking elements 222, 224 can be changed either as a result of the first linking element 222 sliding within the first slot 230 of the brace 214 or as a result of the second linking element 224 sliding within the second slot 232 of the brace 214. More particularly, as shown in FIG. 6, the second distance $L_2$ between the linking elements 222, 224 of the unfolded chair 200 can be realized by urging the first linking element 222 to slide from the outward region 242 of the first slot 230 to the inward region 244 of the first slot 230 while the second linking element 232 is fixed with respect to the brace 214. Alternatively, the reduced distance L2 can also be realized by urging the second linking element 224 to slide from the outward region 246 of the second slot 232 to the inward region 248 of the second slot 232 while the first linking element 222 is fixed with respect to the brace 214.

Consequently, if one of the linking elements 222, 224 is no longer able to slide within the corresponding slot of the safety brace 214, provided that the other linking element is able to slide within its corresponding slot, the brace 214 will not impede a user from tilting the support members with respect to each other. For example, if the safety brace 214 adjacent one of the slots 230, 232 became bent as a result of the slot being hit by another chair or kicked by a person such that the corresponding linking element 222, 224 could not slide within the slot, the other linking member could still slide, thereby allowing for less impeded manipulation of the chair between the folded and unfolded configurations. Thus, the chair 200 of the present invention is more suitable for use in a harsh environment, i.e., one that repeatedly requires the chair to be folded, moved into storage, retrieved from storage, and unfolded for use by rough-handling individuals.

Although the preferred embodiment of the present invention has shown, described and pointed out the fundamental novel features of the invention as applied to this embodiment, it will be understood that various omissions, substitutions and changes in the form of the detail of the device illustrated may be made by those skilled in the art without departing from the spirit of the present invention, Consequently, the scope of the invention should not be limited to the foregoing description, but should be defined by the appending claims.

What is claimed is:

1. A folding chair having a folded and an unfolded configuration comprising:

a first support member having a first linking element;

a second support member having a second linking element, wherein the first and second chair support members are pivotally attached to each other so as to enable tilting of the first chair support member with respect to the second chair support member, said folded configuration resulting in (a) the first and second chair support members being substantially aligned with each other and (b) the first and second linking elements being a first distance apart, said unfolded configuration resulting in (a) the first and second chair support members being substantially tilted with respect to each other and (b) the first and second linking elements being a second distance from each other;

a seat that is attached to the first and second chair support members, wherein the seat is substantially aligned with the first and second chair support members when the chair is in the folded configuration and wherein the seat is substantially parallel to a surface upon which the first and second chair support members are positioned when the chair is in the unfolded configuration so as to enable a user to rest thereon in a seated position; and a first brace member having first and second ends, wherein the first end of the first brace member is slidably attached to the first linking element of the first chair support member and wherein the second end of the first brace member is slidably attached to the second linking element, said first brace member allowing the distance between the first and second linking elements to vary between the first and second distances so as to enable the chair to be manipulated between the folded and unfolded configurations, said first brace member inhibiting the distance between the first and second linking elements from increasing beyond the second distance so as to reduce the likelihood of the chair collapsing in response to a downward force applied on the seat when the seat is in the unfolded configuration.

2. The folding chair of claim 1, wherein the first chair support member comprises opposing parallel first and second side sections and a lateral section extending therebetween such that the side sections of the first support member form a pair of front legs, and wherein the second chair support member comprises opposing parallel first and second side sections and a lateral section extending therebetween such that the side sections of the second support member form a pair of rear legs.

3. The folding chair of claim 2, wherein the first side section of the first chair support member is pivotally attached to the first side section of the second chair support member so as to define a first pivot axis, and wherein the second side section of the first chair support member is pivotally attached to the second side section of the second chair support member so as to define a second pivot axis that is substantially aligned with the first pivot axis.

4. The folding chair of claim 3, wherein (a) the first linking element extends from the first side section of the first chair support member, (b) the second linking element extends from the first side section of the second chair support member, and (c) the first brace member is disposed adjacent the first side sections of the first and second chair support members.

5. The folding chair of claim 3, further comprising a second brace member substantially identical to the first brace member, said second brace member disposed adjacent the second side sections of the first and second chair support members.

6. The folding chair of claim 3, wherein the first linking element comprises a shank portion having a first diameter that extends from an inwardly facing surface of the first side section of the first chair support member, and wherein the second linking element comprises a shank portion having a second diameter that extends from an outwardly facing surface of the first side section of the second chair support member.

7. The folding chair of claim 6, wherein the first brace member has an elongate planar shape that extends between a first and second end of the brace member, said first brace member defining a first elongate slot adjacent the first end of the first brace member and a second elongate slot adjacent the second end of the first brace member, said first and second slots having respective lateral widths that are marginally greater than the first and second diameters, said shank portions of the first and second linking elements respectively extending through the first and second slots of the first brace member.

8. The folding chair of claim 7, wherein the first brace member comprises a first and second lateral edge, wherein the first lateral edge partially defines the first slot and the second lateral edge partially defines the second slot, said first lateral edge engaging with the shank portion of the first linking element and said second lateral edge engaging with the shank portion of the second linking element when the folding chair is in the unfolded configuration.

9. The folding chair of claim 8, wherein each of the first and second linking elements further comprise respective head portions extending from the shank portions, said head portions capturing the first brace member, said first brace member interposed between the heads of the first and second linking elements and the first side sections of the first and second chair support members.

10. The folding chair of claim 1, wherein the first brace member is substantially aligned with the first and second support members when the folding chair is in the folded configuration.

11. The folding chair of claim 1, wherein the first linking element is able to rotate with respect to the first end of the first brace member and the second linking element is able to rotate with respect to the second end of the first brace member so as to enable the first brace member to substantially align with the first and second support members when the folding chair is in the folded configuration.

12. The folding chair of claim 1, wherein the first end of the first brace member is slidable over a first interval with respect to the first linking element and the second end of the first brace member is slidable over a second interval with respect to the second linking element, each of said first and second intervals being approximately greater than the difference between the first and second distances between the first and second linking elements so as to enable the chair to be manipulated between the folded and unfolded configurations even if one of the first and second linking elements is no longer able to slide with respect to the brace member.

13. The folding chair of claim 1, wherein the first brace member consists of a single rigid element.

14. A folding chair comprising:

a first support member;

a second support member pivotally attached to the first support member so as to enable the first support member to be tilted with respect to the second support member between (a) an unfolded position such that an opening angle is defined between the first and second support members and (b) a folded position such that the first and second support members are substantially aligned with each other;

a seat member coupled to the first and second support members, said seat member substantially aligning with the first and second support members when the first and second support members are in the folded position, said seat member extending between the first and second support members when the first and second support members are in the unfolded position so that the seat member is able to support the weight of an individual;

a first and second rigid safety brace member each having a first and second end, wherein the first ends of the first and second safety brace members are slidably and rotatably attached to the first support member, wherein the second ends of the first and second safety brace members are slidably and rotatably attached to the second support member, wherein the first and second safety brace members inhibit the first and second support members from hyperextending beyond the open angle, wherein the first and second safety brace members provide the first and second support members with the freedom to tilt between the unfolded position and the folded position.

15. The folding chair of claim 14, wherein the first support member comprises opposing parallel left and right side sections and a lateral section extending therebetween such that the side sections of the first support member form a pair of front legs, and wherein the second chair support member comprises opposing parallel left and right side sections and a lateral section extending therebetween such that the side sections of the second support member form a pair of rear legs.

16. The folding chair of claim 15, wherein the left side section of the first support member is pivotally attached to the left side section of the second support member so as to define a first pivot axis, and wherein the right side section of the first support member is pivotally attached to the right side section of the second support member so as to define a second pivot axis that is substantially aligned with the first pivot axis.

17. The folding chair of claim 16, wherein each of the first and second safety brace members defines a first and second slot adjacent the respective first and second ends.

18. The folding chair of claim 17, wherein (a) the left side section of the first support member comprises a left first linking element extending therefrom which is slidably and rotatably engaged with the first slot of the first safety brace member, (b) the left side section of the second support member comprises a left second linking element extending therefrom which is slidably and rotatably engaged with the second slot of the first safety brace member, (c) the right side section of the first support member comprises a right first linking element extending therefrom which is slidably and rotatably engaged with the first slot of the second safety brace member, and (d) the right side section of the second support member comprises a right second linking element extending therefrom which is slidably and rotatably engaged with the second slot of the second safety brace member.

19. A folding chair comprising:

a first support member;

a second support member pivotally attached to the first support member so as to enable the first support member to be tilted with respect to the second support member between (a) an unfolded configuration such that an opening angle is defined between the first and second support members and (b) a folded configuration such that the first and second support members ate substantially aligned with each other;

a seat member coupled to the first and second support members, said seat member substantially aligning with the first and second support members when the first and second support members are in the folded configuration, said seat member extending between the first and second support members when the first and second support members are in the unfolded configuration so that the seat member is able to support the weight of an individual; and a brace member having a first and a second end, wherein the first end of the brace member is attached to the first support member such that the first end of the brace member is movable with at least two degrees of freedom over a first interval with respect to the first support member, wherein the second end of the brace member is attached to the second support member such that the second end of the brace member is movable with at least two degrees of freedom over a second interval with respect to the second support member, wherein the brace member inhibits the first and second support members from hyperextending beyond the open angle, wherein the first and second intervals are selected so that the brace member does not inhibit the first and second support members from tilting with respect to each other between the folded and unfolded configurations even if one of the first and second ends of the brace member is no longer able to move with respect to the corresponding first or second support members.

20. The folding chair of claim 19, wherein the brace member defines respective first and second elongated slots adjacent the first and second ends, wherein the first and second intervals are determined by the respective lengths of the first and second elongated slots of the brace member.

21. The folding chair of claim 20, wherein the first support member comprises (a) a first linking element extending therefrom which extends through the first slot of the brace member and (b) a second linking element extending therefrom which extends through the second slot of the brace member.

22. The folding chair of claim 21, wherein each of the first and second linking elements comprises a shank portion and a head portion extending from the shank portion, wherein the shank portions of the first and second linking elements have a width less than the width of the respective first and second slots of the brace member, wherein the shank portions of the first and second linking elements extend through the respective first and second slots of the brace member, wherein the first end of the brace member is interposed between the first support member and the head of the first linking element and the second end of the brace member is interposed between the second support member and the head of the second linking element, and wherein the head portions of the first and second linking elements have a width greater than that of the respective first and second slots so that the brace member is captured by the first and second linking elements.

* * * * *